US006328436B1

(12) United States Patent
Floyd et al.

(10) Patent No.: US 6,328,436 B1
(45) Date of Patent: Dec. 11, 2001

(54) ELECTRO-STATIC PARTICULATE SOURCE, CIRCULATION, AND VALVING SYSTEM FOR BALLISTIC AEROSOL MARKING

(75) Inventors: Philip D. Floyd, Sunnyvale; David K. Biegelsen, Portola Valley; Eric Peeters, Fremont; Frederick J. Endicott, San Carlos, all of CA (US); Richard P. N. Veregin, Mississauga (CA); Gregory B. Anderson, Woodside, CA (US); Karen A. Moffat, Brantford (CA); Maria N. V. McDougall, Burlington (CA); Jaan Noolandi, Mississauga (CA); Armin R. Volkel, Mississauga (CA); Tuan Anh Vo, Hawthorne; Kaiser H. Wong, Torrance, both of CA (US); Peter M. Kazmaier, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/474,690

(22) Filed: Dec. 29, 1999

Related U.S. Application Data

(60) Provisional application No. 60/157,100, filed on Sep. 30, 1999.

(51) Int. Cl.[7] ..... B11J 2/215

(52) U.S. Cl. ..... 347/85; 347/21; 347/83; 347/112

(58) Field of Search ..... 347/85, 86, 87, 347/15, 20, 21, 54, 55, 56, 61, 66, 73, 83, 112

(56) References Cited

U.S. PATENT DOCUMENTS

| | | | |
|---|---|---|---|
| 2,573,143 | 10/1951 | Jacob | 178/5.2 |
| 2,577,894 | 12/1951 | Jacob | 346/75 |
| 3,152,858 | 10/1964 | Wadey | 346/75 |
| 3,572,591 | 3/1971 | Brown | 239/337 |
| 3,977,323 | 8/1976 | Pressman et al. | 101/426 |
| 3,997,113 | 12/1976 | Pennebaker, Jr. | 239/15 |
| 4,019,188 | 4/1977 | Hochberg et al. | 346/75 |
| 4,106,032 | 8/1978 | Miura et al. | 347/21 |
| 4,113,598 | 9/1978 | Jozwiak, Jr. et al. | 204/181 R |
| 4,146,900 | 3/1979 | Arnold | 346/75 |
| 4,171,777 | 10/1979 | Behr | 239/422 |
| 4,189,937 | 2/1980 | Nelson | 73/28 |
| 4,196,437 | 4/1980 | Hertz | 346/1.1 |
| 4,223,324 | 9/1980 | Yamamori et al. | 347/21 |
| 4,265,990 | 5/1981 | Stolka et al. | 430/59 |
| 4,271,100 | 6/1981 | Trassy | 261/78 A |
| 4,284,418 | 8/1981 | Andres | 55/16 |
| 4,368,850 | 1/1983 | Szekely | 239/333 |
| 4,403,228 | 9/1983 | Miura et al. | 346/75 |

(List continued on next page.)

FOREIGN PATENT DOCUMENTS

| | | |
|---|---|---|
| 0 655 337 A2 | 5/1995 | (EP) . |
| 0 726 158 A1 | 8/1996 | (EP) . |
| 353035539A | 4/1978 | (JP) . |

(List continued on next page.)

OTHER PUBLICATIONS

U. S. Application No. 09/163,518 (Attorney Docket No. D/98577) entitled "Inorganic Overcoat for Particulate Transport Electrode Grid" to Kaiser H. Wong et al., filed Sep. 30, 1998.

(List continued on next page.)

*Primary Examiner*—Anh T. N. Vo

(57) ABSTRACT

In a ballistic aerosol marking device or the like, marking material flows from a material reservoir to a delivery channel via a port. Flow of marking material is facilitated by the provision of electrostatic marking material moving structures in or near the walls of the marking material reservoir. Marking material may be set into a continuous motion past the port and controllably extracted from the reservoir into the channel.

16 Claims, 14 Drawing Sheets

U.S. PATENT DOCUMENTS

| | | | | |
|---|---|---|---|---|
| 4,403,234 | | 9/1983 | Miura et al. | 324/59 |
| 4,480,259 | | 10/1984 | Kruger et al. | 347/63 |
| 4,490,728 | | 12/1984 | Vaught et al. | 347/60 |
| 4,500,895 | | 2/1985 | Buck et al. | 347/87 |
| 4,514,742 | * | 4/1985 | Suga et al. | 347/85 |
| 4,515,105 | | 5/1985 | Danta et al. | 118/629 |
| 4,523,202 | | 6/1985 | Gamblin | 346/75 |
| 4,544,617 | | 10/1985 | Mort et al. | 430/58 |
| 4,606,501 | | 8/1986 | Bate et al. | 239/346 |
| 4,607,267 | | 8/1986 | Yamamuro | 347/51 |
| 4,613,875 | | 9/1986 | Le et al. | 347/21 |
| 4,614,953 | | 9/1986 | Lapeyre | 347/43 |
| 4,634,647 | | 1/1987 | Jansen et al. | 430/84 |
| 4,647,179 | | 3/1987 | Schmidlin | 355/3 DD |
| 4,663,258 | | 5/1987 | Pai et al. | 430/57 |
| 4,666,806 | | 5/1987 | Pai et al. | 430/57 |
| 4,683,481 | | 7/1987 | Johnson | 347/65 |
| 4,720,444 | | 1/1988 | Chen | 430/58 |
| 4,728,969 | | 3/1988 | Le et al. | 347/21 |
| 4,741,930 | | 5/1988 | Howard et al. | 427/265 |
| 4,760,005 | | 7/1988 | Pai | 430/65 |
| 4,770,963 | | 9/1988 | Pai et al. | 430/64 |
| 4,839,232 | | 6/1989 | Morita et al. | 428/473.5 |
| 4,839,666 | | 6/1989 | Jayne | 346/75 |
| 4,870,430 | | 9/1989 | Daggett et al. | 347/88 |
| 4,882,245 | | 11/1989 | Gelorme et al. | 430/14 |
| 4,896,174 | | 1/1990 | Stearns | 346/459 |
| 4,929,968 | | 5/1990 | Ishikawa | 347/21 |
| 4,961,966 | | 10/1990 | Stevens et al. | 427/299 |
| 4,973,379 | | 11/1990 | Brock et al. | 156/640 |
| 4,982,200 | | 1/1991 | Ramsay | 346/75 |
| 5,030,536 | | 7/1991 | Pai et al. | 430/127 |
| 5,041,849 | | 8/1991 | Quate et al. | 347/46 |
| 5,045,870 | | 9/1991 | Lamey et al. | 324/59 |
| 5,063,655 | | 11/1991 | Lamey et al. | 29/611 |
| 5,066,512 | | 11/1991 | Goldowsky et al. | 427/14.1 |
| 5,113,198 | | 5/1992 | Nishikawa et al. | 347/21 |
| 5,190,817 | | 3/1993 | Terrell et al. | 428/343 |
| 5,202,704 | | 4/1993 | Iwao | 347/55 |
| 5,208,630 | | 5/1993 | Goodbrand et al. | 355/201 |
| 5,209,998 | | 5/1993 | Kavassalis et al. | 430/106 |
| 5,240,153 | | 8/1993 | Tubaki et al. | 222/385 |
| 5,240,842 | | 8/1993 | Mets | 435/172.3 |
| 5,294,946 | | 3/1994 | Gandy et al. | 347/3 |
| 5,300,339 | | 4/1994 | Hays et al. | 428/36.9 |
| 5,350,616 | | 9/1994 | Pan et al. | 428/131 |
| 5,363,131 | | 11/1994 | Momose et al. | 347/46 |
| 5,385,803 | | 1/1995 | Duff et al. | 430/138 |
| 5,403,617 | | 4/1995 | Haaland | 427/180 |
| 5,425,802 | | 6/1995 | Burton et al. | 95/32 |
| 5,426,458 | | 6/1995 | Wenzel et al. | 347/45 |
| 5,428,381 | | 6/1995 | Hadimioglu et al. | 347/46 |
| 5,482,587 | | 1/1996 | McAleavey | 156/243 |
| 5,510,817 | | 4/1996 | Sohn | 347/21 |
| 5,512,712 | | 4/1996 | Iwata et al. | 174/258 |
| 5,520,715 | | 5/1996 | Oeftering | 75/335 |
| 5,522,555 | | 6/1996 | Poole | 241/33 |
| 5,535,494 | | 7/1996 | Plesinger et al. | 29/25.35 |
| 5,541,625 | | 7/1996 | Holstun et al. | 347/5 |
| 5,554,480 | | 9/1996 | Patel et al. | 430/137 |
| 5,600,351 | | 2/1997 | Holstun et al. | 347/40 |
| 5,604,519 | | 2/1997 | Keefe et al. | 347/13 |
| 5,635,969 | | 6/1997 | Allen | 347/96 |
| 5,640,187 | | 6/1997 | Kashiwazaki et al. | 347/101 |
| 5,646,656 | | 7/1997 | Leonhardt et al. | 347/43 |
| 5,654,744 | | 8/1997 | Nicoloff, Jr. et al. | 347/43 |
| 5,678,133 | | 10/1997 | Siegel | 399/67 |
| 5,682,190 | | 10/1997 | Hirosawa et al. | 347/94 |
| 5,712,669 | | 1/1998 | Swanson et al. | 347/49 |
| 5,717,986 | | 2/1998 | Vo et al. | 399/291 |
| 5,731,048 | | 3/1998 | Ashe et al. | 427/585 |
| 5,756,190 | | 5/1998 | Hosomi et al. | 428/209 |
| 5,761,783 | | 6/1998 | Osawa et al. | 29/25.35 |
| 5,777,636 | | 7/1998 | Naganuma et al. | 347/10 |
| 5,787,558 | | 8/1998 | Murphy | 29/25.35 |
| 5,818,477 | | 10/1998 | Fullmer et al. | 347/43 |
| 5,828,388 | | 10/1998 | Cleary et al. | 347/21 |
| 5,853,906 | | 12/1998 | Hsieh | 428/690 |
| 5,882,830 | | 3/1999 | Visser et al. | 430/59 |
| 5,893,015 | | 4/1999 | Mojarradi et al. | 399/291 |
| 5,900,898 | | 5/1999 | Shimizu et al. | 347/93 |
| 5,958,122 | | 9/1999 | Fukuda et al. | 106/31.57 |
| 5,967,044 | | 10/1999 | Marschke | 101/363 |
| 5,968,674 | | 10/1999 | Hsieh et al. | 428/690 |
| 5,969,733 | | 10/1999 | Sheinman | 347/75 |
| 5,981,043 | | 11/1999 | Murakami et al. | 428/209 |
| 5,982,404 | | 11/1999 | Iga et al. | 347/173 |
| 5,990,197 | | 11/1999 | Escano et al. | 523/160 |
| 5,992,978 | | 11/1999 | Fujii et al. | 347/54 |
| 6,019,466 | | 2/2000 | Hermanson | 347/104 |
| 6,036,295 | | 3/2000 | Ando et al. | 347/7 |
| 6,081,281 | | 6/2000 | Cleary et al. | 347/21 |
| 6,116,718 | | 9/2000 | Peeters et al. | 347/21 |

FOREIGN PATENT DOCUMENTS

| | | |
|---|---|---|
| 53035539 A | 4/1978 | (JP) . |
| 55 019556 | 2/1980 | (JP) . |
| 55 028819 | 2/1980 | (JP) . |
| 56 146773 | 11/1981 | (JP) . |
| 58-224760 | 12/1983 | (JP) . |
| 60 229764 | 11/1985 | (JP) . |
| 362035847A | 2/1987 | (JP) . |
| 02 293151 | 12/1990 | (JP) . |
| 4-158044 | 6/1992 | (JP) . |
| 4-182138 | 6/1992 | (JP) . |
| 5-4348 | 1/1993 | (JP) . |
| 5-193140 | 8/1993 | (JP) . |
| 5-269995 | 10/1993 | (JP) . |
| WO 93/11866 | 6/1993 | (WO) . |
| WO 94/18011 | 8/1994 | (WO) . |
| WO 97/01449 | 1/1997 | (WO) . |
| WO 97/27058 | 7/1997 | (WO) . |

OTHER PUBLICATIONS

U. S. Application No. 09/163,664 (Attorney Docket No. D/98566) entitled "Organic Overcoat for Electrode Grid" to Kaiser H. wong et al., filed Sep. 30, 1998.

U. S. Application No. 09/163,799 (Attorney Docket D/98565Q1) entitled "Method of Making a Print Head for Use in a Ballistic Aerosol Marking Apparatus" to Eric Peeters et al., filed Sep. 30, 1998.

U. S. Application No. 09/163,825 (Attorney Docket D/98563) entitled "Multi–Layer Organic Overcoat for Electrode Grid" to Kaiser H. Wong, filed Sep. 30, 1998.

U. S. Application No. 09/163,839 (Attorney Docket D/98314) entitled "Ballistic Aerosol Marking Apparatus for Marking a Substrate" to Tuan Anh Vo et al, filed Sep. 30, 1998.

U. S. Application No. 09/163,924 (Attorney Docket D/98562Q1) entitled "Method for Marking with a Liquid Material Using a Ballistic Aerosol Marking Apparatus" to Eric Peeters et al., filed Sep. 30, 1998.

U. S. Application No. 09/164,104 (Attorney Docket D/98564) "Kinetic Fusing of a Marking Material" to Jaan Noolandi et al., filed Sep. 30, 1998.

U. S. Application No. 09/163,765 (Attorney Docket D/98314Q4) entitled "Cartridge for Use in a Ballistic Aerosol Marking Apparatus" to Eric Peeters et al., file Sep. 30, 1998.

U. S. Application No. 09/163,808 (Attorney Docket D/98314Q3) entitled "Method of Treating a Substrate Employing a Ballistic Aerosol Marking Apparatus" to Eric Peeters et al., filed Sep. 30, 1998.

U. S. Application No. 09/164,250 (Attorney Docket D/98314Q2) entitled "Ballistic Aerosol Marking Apparatus for Treating a substrate" to.Eric Peeters et al., filed Sep. 30, 1998.

U. S. Application No. 09/407,908 (Attorney Docket D/98314I2) entitled "Ballistic Aerosol Marking Apparatus with Stacked Electrode Structure" to Philip D. Floyd et al., filed Sep. 29, 1999.

U. S. Application No. 09/164,124 (Attorney Docket D/98314Q1) entitled "Method of Marking a Substrate Employing a Ballistic Aerosol Marking Apparatus" to Eric Peeters et al., filed Sep. 30, 1998.

U. S. Application No. 09/163,839 (Attorney Docket D/98409) entitled"Marking Material Transport" to Tuan Anh Vo et al., filed Sep. 30, 1998.

U. S. Application No. 09/163,954 (Attorney Docket D/98562) entitled Ballistic Aerosol Marking Apparatus for Marking with a Liquid Material to Eric Peeters et al., filed Sep. 30, 1998.

F. Anger, Jr. et al. Low Surface Energy Fluoro–Epoxy Coating for Drop–On–Demand Nozzles, IBM Technical Disclosure Bulletin, Vol. 26, No. 1, p. 431, Jun. 1983.

N. A. Fuchs. The Mechanics Of Aerosols, Dover Publications, Inc., p. 79, 367–377, 1989 (Originally published in 1964 by Pergamon Press Ltd.)

Hue Le et al. Air–Assisted Ink Jet with Mesa–Shaped Ink–Drop–Forming Orifice, Presented at the Fairmont Hotel in Chicago and San Jose, Fall 1987, p. 223–227.

No author listed, Array Printers Demonstrates First Color Printer Engine, The Hard Copy Observer Published by Lyra Research, Inc. Vol. VIII, No. 4, p. 36, Apr. 1998.

U. S. Application No. 09/041,353, Coated Photographic Papers, Filed Mar. 12, 1998.

U. S. Application No. 09/410,371, Ballistic Aerosol Marking Apparatus with Non–Wetting Coating, filed Sep. 30, 1999.

* cited by examiner

ELECTRO-STATIC PARTICULATE SOURCE, CIRCULATION, AND VALVING SYSTEM FOR BALLISTIC AEROSOL MARKING

This application claims the priority benefit of U.S. Provisional Application No. 60/157,100, filed Sep. 30, 1999, and hereby incorporates same by reference thereto.

CROSS-REFERENCE TO RELATED APPLICATIONS

The present invention is related to U.S. patent applications Ser. Nos. 09/163,893, 09/164,124, 09/164,250, 09/163,808, 09/163,765, 09/163,839, 09/163,954, 09/163,924, 09/163,904, 09/163,799, 09/163,664, 09/163,518, 09/164,104, 09/163,825, 08/128,160, 08/670,734, 08/950,300, 08/950,303, and 09/407,908, and issued U.S. patent Ser. No. 5,717,986, each of the above being incorporated herein by reference.

BACKGROUND

The present invention relates generally to the field of marking devices, and more particularly to a device capable of applying a marking material to a substrate by introducing the marking material into a high-velocity propellant stream.

Ink jet is currently a common printing technology. There are a variety of types of ink jet printing, including thermal ink jet (TIJ), piezo-electric ink jet, etc. In general, liquid ink droplets are ejected from an orifice located at a one terminus of a channel. In a TIJ printer, for example, a droplet is ejected by the explosive formation of a vapor bubble within an ink-bearing channel. The vapor bubble is formed by means of a heater, in the form of a resistor, located on one surface of the channel.

We have identified several disadvantages with TIJ (and other ink jet) systems known in the art. For a 300 spot-per-inch (spi) TIJ system, the exit orifice from which an ink droplet is ejected is typically on the order of about 64 $\mu$m in width, with a channel-to-channel spacing (pitch) of about 84 $\mu$m, and for a 600 dpi system width is about 35 $\mu$m and pitch of about 42 $\mu$m. A limit on the size of the exit orifice is imposed by the viscosity of the fluid ink used by these systems. It is possible to lower the viscosity of the ink by diluting it in increasing amounts of liquid (e.g., water) with an aim to reducing the exit orifice width. However, the increased liquid content of the ink results in increased wicking, paper wrinkle, and slower drying time of the ejected ink droplet, which negatively affects resolution, image quality (e.g., minimum spot size, inter-color mixing, spot shape), etc. The effect of this orifice width limitation is to limit resolution of TIJ printing, for example to well below 900 spi, because spot size is a function of the width of the exit orifice, and resolution is a function of spot size.

Another disadvantage of known ink jet technologies is the difficulty of producing greyscale printing. That is, it is very difficult for an ink jet system to produce varying size spots on a printed substrate. If one lowers the propulsive force (heat in a TIJ system) so as to eject less ink in an attempt to produce a smaller dot, or likewise increases the propulsive force to eject more ink and thereby to produce a larger dot, the trajectory of the ejected droplet is affected. This in turn renders precise dot placement difficult or impossible, and not only makes monochrome greyscale printing problematic, it makes multiple color greyscale ink jet printing impracticable. In addition, preferred greyscale printing is obtained not by varying the dot size, as is the case for TIJ, but by varying the dot density while keeping a constant dot size.

Still another disadvantage of common ink jet systems is rate of marking obtained. Approximately 80% of the time required to print a spot is taken by waiting for the ink jet channel to refill with ink by capillary action. To a certain degree, a more dilute ink flows faster, but raises the problem of wicking, substrate wrinkle, drying time, etc. discussed above.

One problem common to ejection printing systems is that the channels may become clogged. Systems such as TIJ which employ aqueous ink colorants are often sensitive to this problem, and routinely employ non-printing cycles for channel cleaning during operation. This is required since ink typically sits in an ejector waiting to be ejected during operation, and while sifting may begin to dry and lead to clogging.

Other technologies which may be relevant as background to the present invention include electrostatic grids, electrostatic ejection (so-called tone jet), acoustic ink printing, and certain aerosol and atomizing systems such as dye sublimation.

SUMMARY

The present invention is employed in a novel system for applying a marking material to a substrate, directly or indirectly, which overcomes the disadvantages referred to above, as well as others discussed further herein. Ballistic aerosol marking apparatus and processes have been described in the aforementioned and incorporated U.S. patent applications, such as Ser. No. 09/163,893. In such an apparatus, a propellant is caused to flow through a channel, and marking material is selectively delivered to the channel whereby it is imparted with sufficient kinetic energy by the propellant stream to impact a substrate. A relatively large number of such channels may be employed to form a print head. Also, a multiplicity of marking materials may be delivered to the channels concurrently, whereby they are mixed in said channels prior to impacting the substrate. Single-pass color printing is one possible benefit obtained from this architecture.

In particular, however, the present invention relates to methods and apparatus for generating and supplying particulates to the channel for a ballistic aerosol marking print head. The particles are generated in an aerosol form above a bed of particulates, excited by gas flow and sonic or ultrasonic vibration, or by mechanical/gas excitation with a rotating mechanical arm, such as a propeller. Additionally particles can be supplied in a liquid form (loosely packed, readily flowing) to the channels by a sonic/ultrasonic vibration and gas flow.

The propellant is usually a dry gas which may continuously flow through the channel while the marking apparatus is in an operative configuration (i.e., in a power-on or similar state ready to mark). The system is referred to as "ballistic aerosol marking" in the sense that marking is achieved by in essence launching a non-colloidal, solid or semi-solid particulate, or alternatively a liquid, marking material at a substrate. The shape of the channel may result in a collimated (or focused) flight of the propellant and marking material onto the substrate.

In our system, the propellant may be introduced at a propellant port into the channel to form a propellant stream. A marking material may then be introduced into the propellant stream from one or more marking material inlet ports. The propellant may enter the channel at a high velocity. Alternatively, the propellant may be introduced into the channel at a high pressure, and the channel may include a constriction (e.g., de Laval or similar converging/diverging type nozzle) for converting the high pressure of the propellant to high velocity. In such a case, the propellant is introduced at a port located at a proximal end of the channel (defined as the converging region), and the marking material ports are provided near the distal end of the channel (at or further down-stream of a region defined as the diverging region), allowing for introduction of marking material into the propellant stream.

In the case where multiple ports are provided, each port may provide for a different color (e.g., cyan, magenta, yellow, and black), pre-marking treatment material (such as a marking material adherent), post-marking treatment material (such as a substrate surface finish material, e.g., matte or gloss coating, etc.), marking material not otherwise visible to the unaided eye (e.g., magnetic particle-bearing material, ultra violet-fluorescent material, etc.) or other marking material to be applied to the substrate. The marking material is imparted with kinetic energy from the propellant stream, and ejected from the channel at an exit orifice located at the distal end of the channel in a direction toward a substrate.

One or more such channels may be provided in a structure which, in one embodiment, is referred to herein as a print head. The width of the exit (or ejection) orifice of a channel is generally on the order of 250 $\mu$m or smaller, preferably in the range of 100 $\mu$m or smaller. Where more than one channel is provided, the pitch, or spacing from edge to edge (or center to center) between adjacent channels may also be on the order of 250 $\mu$m or smaller, preferably in the range of 100 $\mu$m or smaller. Alternatively, the channels may be staggered, allowing reduced edge-to-edge spacing.

The material to be applied to the substrate may be transported to a port by one or more of a wide variety of ways, including simple gravity feed, hydrodynamic, electrostatic, or ultrasonic transport, etc. The material may be metered out of the port into the propellant stream also by one of a wide variety of ways, including control of the transport mechanism, or a separate system such as pressure balancing, electrostatics, acoustic energy, ink jet, etc.

The material to be applied to the substrate may be a solid or semi-solid particulate material such as a toner or variety of toners in different colors, a suspension of such a marking material in a carrier, a suspension of such a marking material in a carrier with a charge director, a phase change material, etc., both visible and non-visible. One preferred embodiment employs a marking material which is particulate, solid or semi-solid, and dry or suspended in a liquid carrier. Such a marking material is referred to herein as a particulate marking material. This is to be distinguished from a liquid marking material, dissolved marking material, atomized marking material, or similar non-particulate material, which is generally referred to herein as a liquid marking material. However, the present invention is able to utilize such a liquid marking material in certain applications, as otherwise described herein. Indeed, the present invention may also be employed in the use of non-marking materials, such as marking pre- and post-treatments, finishes, curing or sealing materials, etc., and accordingly the present disclosure and claims should be read to broadly encompass the transport and marking of wide variety of materials. Thus, the present invention and its various embodiments provide numerous advantages discussed above, as well as additional advantages which will be described in further detail below.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described, such as pressures, velocities, widths, lengths, etc. These recited ranges are to be treated as examples only, and are not intended to limit the scope of the claims hereof. In addition, a number of materials are identified as suitable for various facets of the embodiments, such as for marking materials, propellants, body structures, etc. These recited materials are also to be treated as exemplary, and are not intended to limit the scope of the claims hereof.

Figure 1:
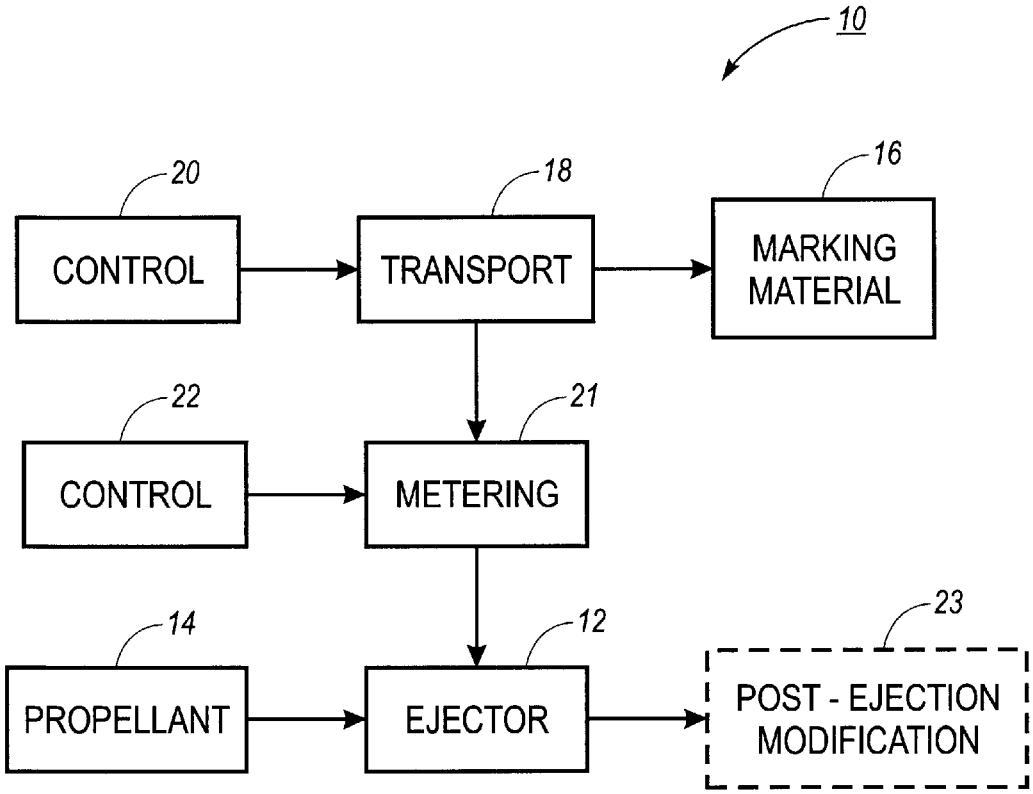
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 consists of one or more ejectors 12 to which a propellant 14 is fed. A marking material 16, which may be transported by a transport 18 under the control of control 20 is introduced into ejector 12. (Optional elements are indicated by dashed lines.) The marking material is metered (that is controllably introduced) into the ejector by metering means 21, under control of control 22. The marking material ejected by ejector 12 may be subject to post ejection modification 23, optionally also part of device 10. It will be appreciated that device 10 may form a part of a printer, for example of the type commonly attached to a computer network, personal computer or the like, part of a facsimile machine, part of a document duplicator, part of a labeling apparatus, or part of any other of a wide variety of marking devices.

Figure 2:
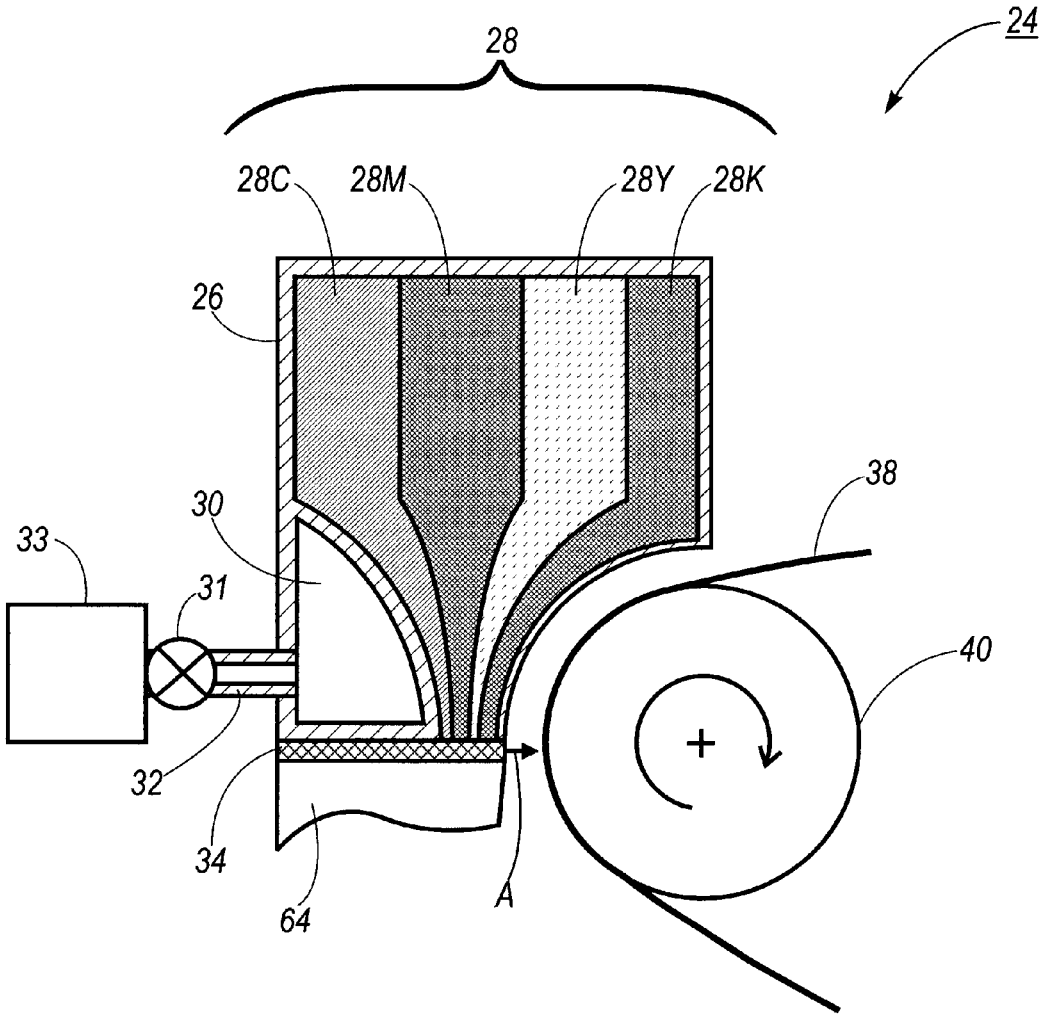
FIG. 2 is cross sectional illustration of a marking apparatus according to one embodiment of the present invention.

The embodiment illustrated in FIG. 1 may be realized by a ballistic aerosol marking device 24 of the type shown in the cut-away side view of FIG. 2. According to this embodiment, the materials to be deposited will be 4 colored toners, for example cyan (C), magenta (M), yellow (Y), and black (K), of a type described further herein, which may be deposited concomitantly, either mixed or unmixed, successively, or otherwise. While the illustration of FIG. 2 and the associated description contemplates a device for marking with four colors (either one color at a time or in mixtures thereof), a device for marking with a fewer or a greater number of colors, or other or additional materials such as materials creating a surface for adhering marking material particles (or other substrate surface pre-treatment), a desired substrate finish quality (such as a matte, satin or gloss finish or other substrate surface post-treatment), material not visible to the unaided eye (such as magnetic particles, ultra violet-fluorescent particles, etc.) or other material associated with a marked substrate, is clearly contemplated herein.

Device 24 consists of a body 26 within which is formed a plurality of cavities 28C, 28M, 28Y, and 28K (collectively referred to as cavities 28) for receiving materials to be deposited. Also formed in body 26 may be a propellant cavity 30. A fitting 32 may be provided for connecting propellant cavity 30 to a propellant source 33 such as a compressor, a propellant reservoir, or the like. Body 26 may be connected to a print head 34, comprised of among other layers, substrate 36 and channel layer 37 that will be discussed later.

Figure 3:
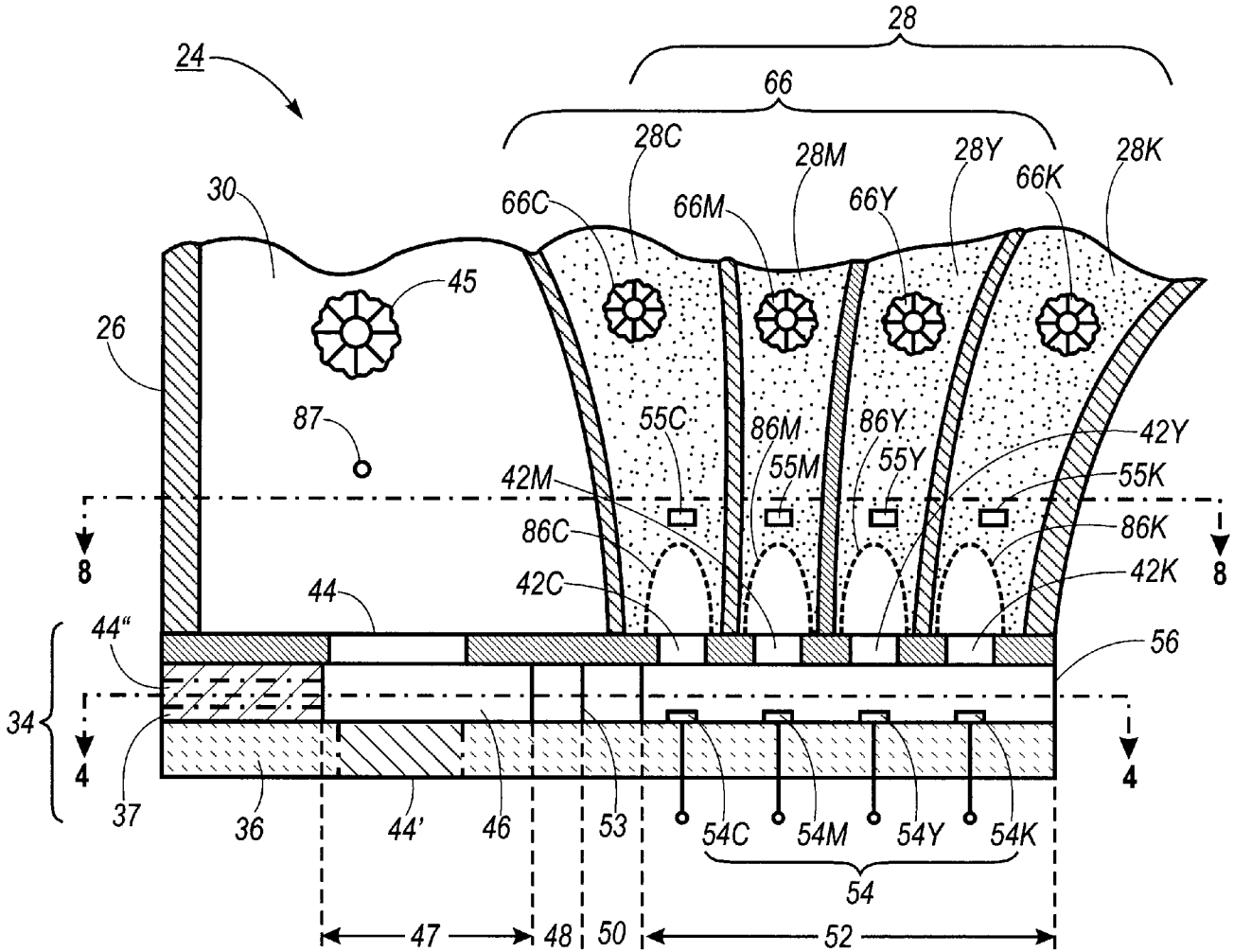
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively, of circular, oval, rectangular or other cross-section, providing communication between said cavities and a channel 46 which adjoins body 26. Ports 42 are shown having a longitudinal axis roughly perpendicular to the longitudinal axis of channel 46. However, the angle between the longitudinal axes of ports 42 and channel 46 may be other than 90 degrees, as appropriate for the particular application of the present invention.

Likewise, propellant cavity 30 includes a port 44, of circular, oval, rectangular or other cross-section, between said cavity and channel 46 through which propellant may travel. Alternatively, print head 34 may be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. We have experimentally demonstrated a propellant marking material flow pattern from a print head employing a number of the features described herein which remains relatively collimated for a distance of up to 10 millimeters, with an optimal printing spacing on the order of between one and several millimeters. For example, the print head produces a marking material stream which does not deviate by more than between 20 percent, and preferably by not more than 10 percent, from the width of the exit orifice for a distance of at least 4 times the exit orifice width. However, the appropriate spacing between the print head and the substrate is a function of many parameters, and does not itself form a part of the present invention.

Referring again to FIG. 3, according to one embodiment of the present invention, print head 34 consists of a substrate 36 and channel layer 37 in which is formed channel 46. Additional layers, such as an insulating layer, capping layer, etc. (not shown) may also form a part of print head 34. Substrate 36 is formed of a suitable material such as glass, ceramic, etc., on which (directly or indirectly) is formed a relatively thick material, such as a thick permanent photoresist (e.g., a liquid photosensitive epoxy such as SU-8, from Microlithography Chemicals, Inc; see also U.S. patent Ser. No. 4,882,245) and/or a dry film-based photoresist such as the Riston photopolymer resist series, available from DuPont Printed Circuit Materials, Research Triangle Park, N.C. (see, www.dupont.com/pcm/) which may be etched, machined, or otherwise in which may be formed a channel with features described below.

Figure 4:
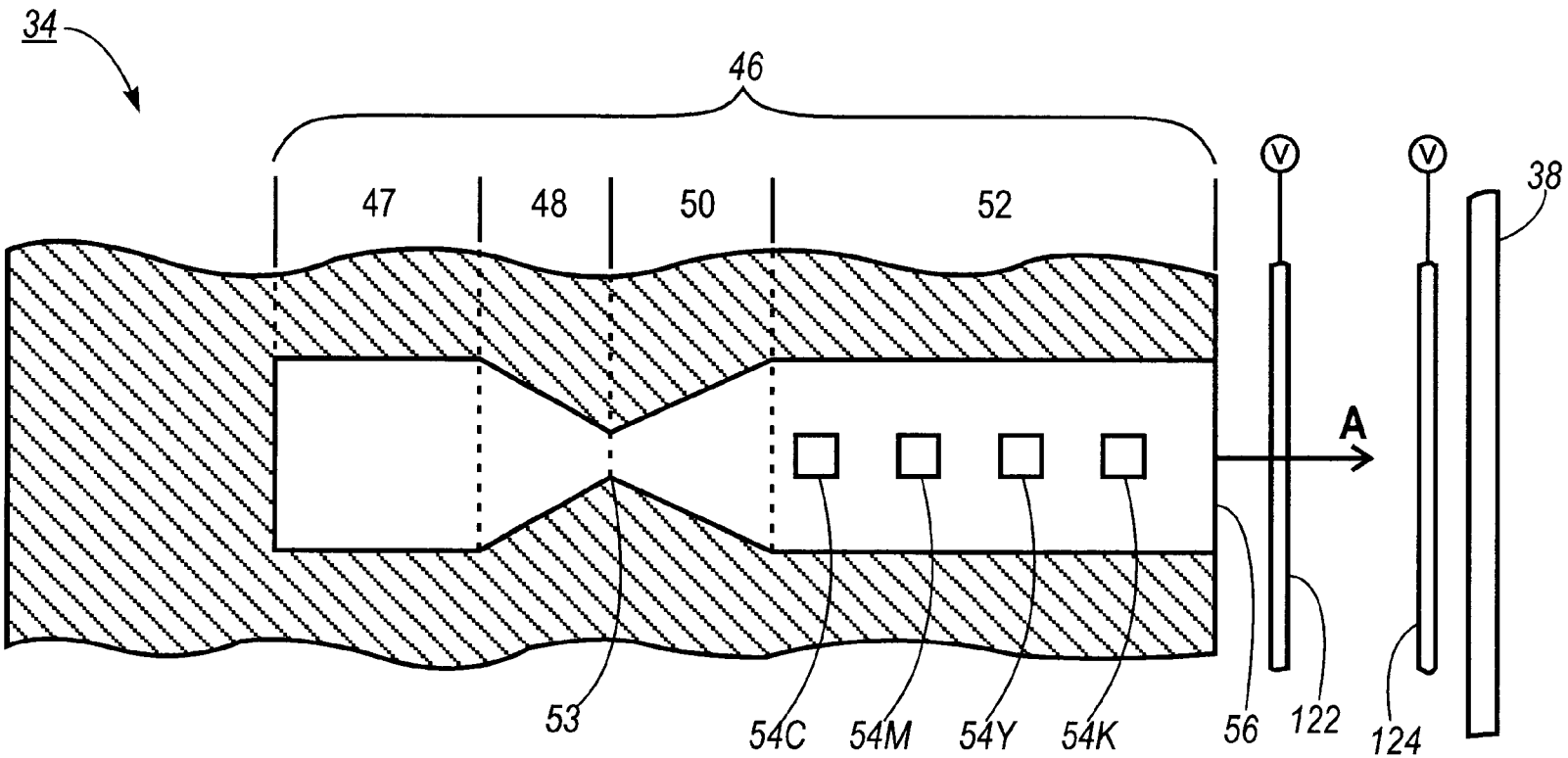
FIG. 4 is a plan view of one channel, with nozzle, of the marking apparatus shown in FIG. 3.

Referring now to FIG. 4, which is a cut-away plan view of print head 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe. An exit orifice 56 is located at the distal end of channel 46.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant may continuously flow through the channel while the marking apparatus is in an operative configuration (e.g., a "power on" or similar state ready to mark), or may be modulated such that propellant passes through the channel only when marking material is to be ejected, as dictated by the particular application of the present invention. Such propellant modulation may be accomplished by a valve 31 interposed between the propellant source 33 and the channel 46, by modulating the generation of the propellant for example by turning on and off a compressor or selectively initiating a chemical reaction designed to generate propellant, or by other means not shown.

Marking material may controllably enter the channel through one or more ports 42 located in the marking material injection region 52. That is, during use, the amount of marking material introduced into the propellant stream may be controlled from zero to a maximum per spot. The propellant and marking material travel from the proximal end to a distal end of channel 46 at which is located exit orifice 56.

Figure 5A:
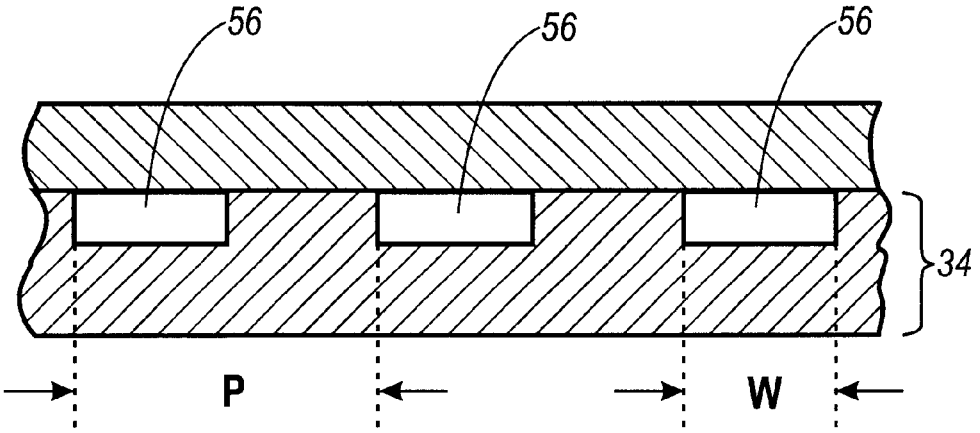
FIGS. 5A and 5B are end views of non-staggered and two-dimensionally staggered arrays of channels according to the present invention.
Figure 5B:
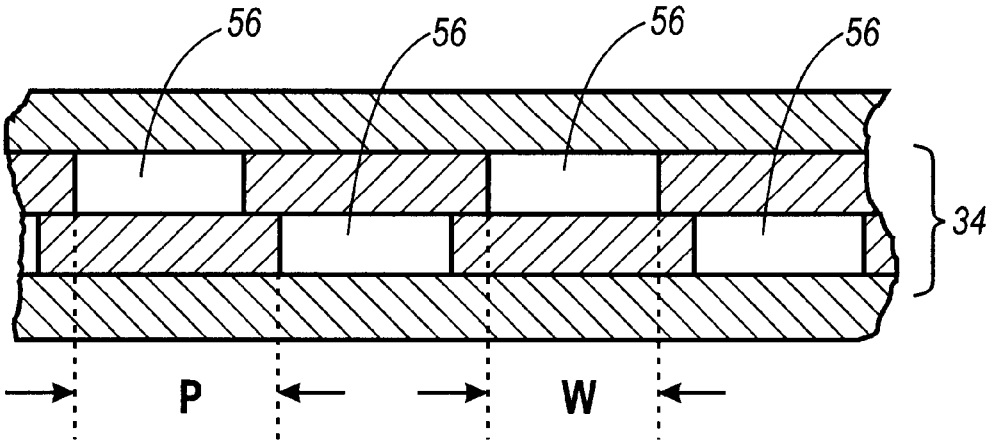

While FIG. 4 illustrates a print head 34 having one channel therein, it will be appreciated that a print head according to the present invention may have an arbitrary number of channels, and range from several hundred micrometers across with one or several channels, to a page-width (e.g., 8.5 or more inches across) with thousands of channels. The width W of each exit orifice 56 may be on the order of 250 μm or smaller, preferably in the range of 100 μm or smaller. The pitch P, or spacing from edge to edge (or center to center) between adjacent exit orifices 56 may also be on the order of 250 μm or smaller, preferably in the range of 100 μm or smaller in non-staggered array, illustrated in end view in FIG. 5A. In a two-dimensionally staggered array, of the type shown in FIG. 5B, the pitch may be further reduced. For example, Table 1 illustrates typical pitch and width dimensions for different resolutions of a non-staggered array.

TABLE 1

| Resolution | Pitch | Width |
|---|---|---|
| 300 | 84 | 60 |
| 600 | 42 | 30 |
| 900 | 32 | 22 |
| 1200 | 21 | 15 |

Figure 6:
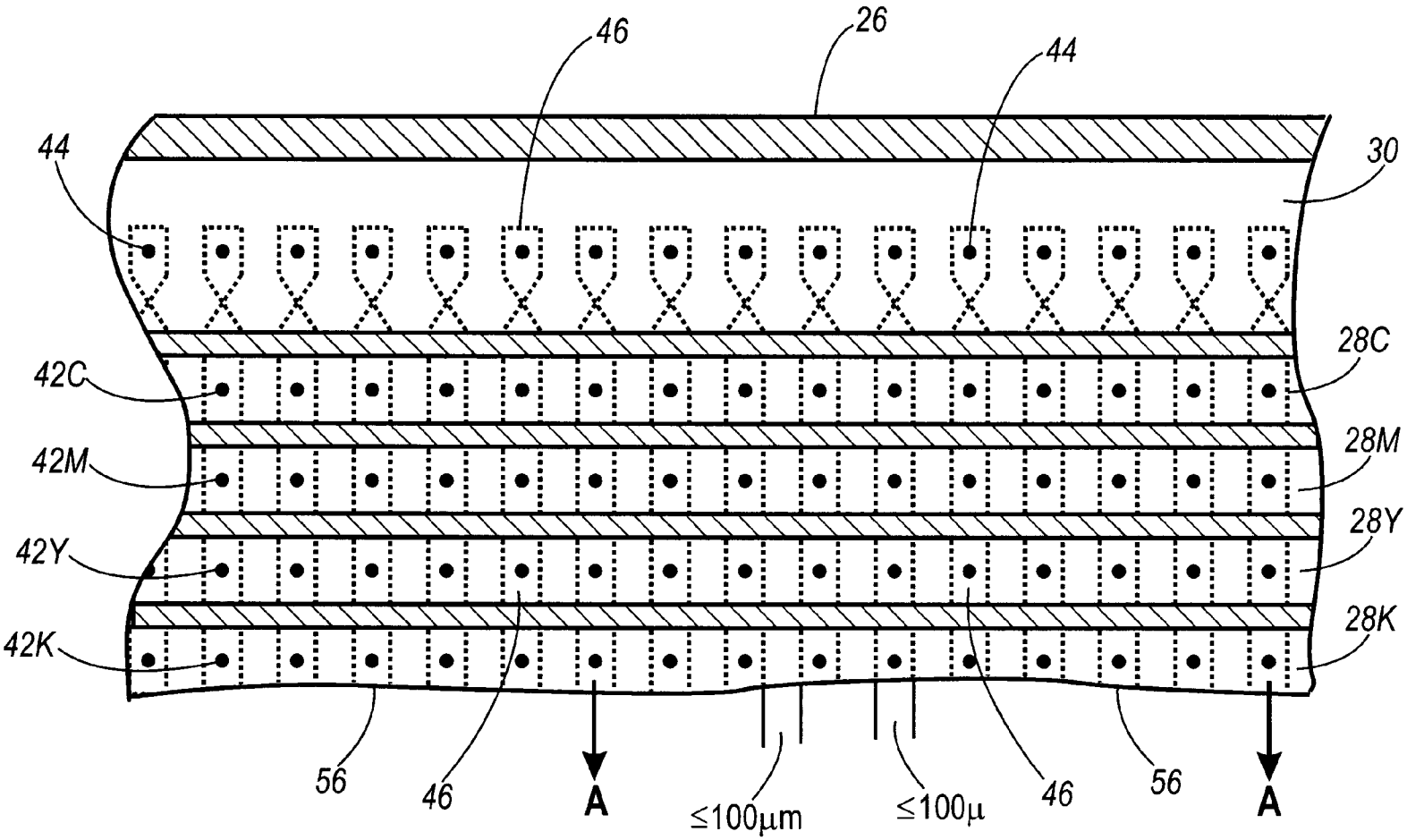
FIG. 6 is a plan view of an array of channels of an apparatus according to one embodiment of the present invention.
Figure 7A:
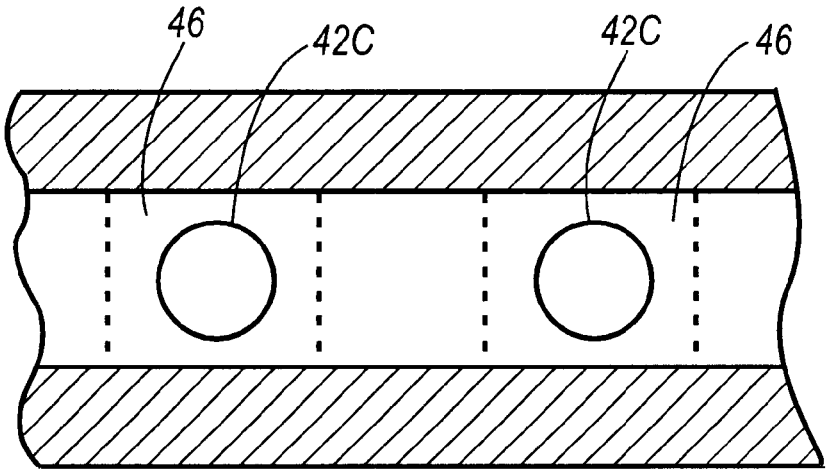
FIGS. 7A and 7B are plan views of a portion of the array of channels shown in FIG. 6, illustrating two embodiments of ports according to the present invention.
Figure 7B:
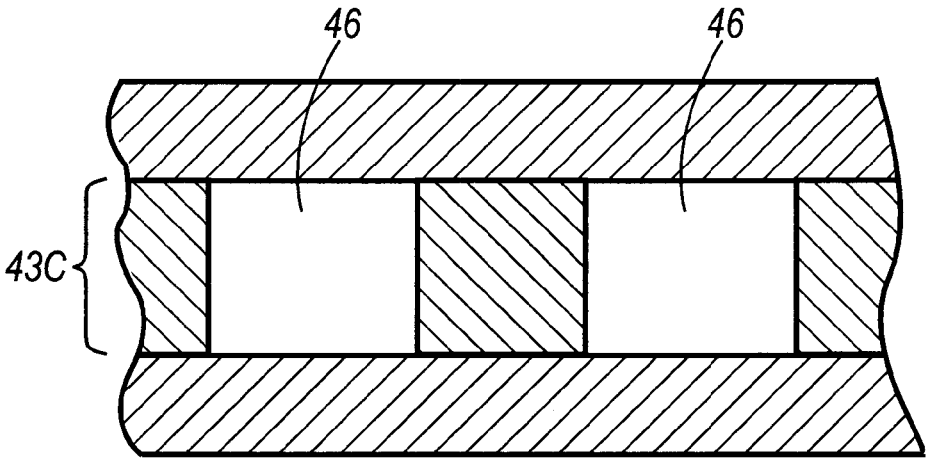

As illustrated in FIG. 6, a wide array of channels in a print head may be provided with marking material by continuous cavities 28, with ports 42 associated with each channel 46. Likewise, a continuous propellant cavity 30 may service each channel 46 through an associated port 44. Ports 42 may be discrete openings in the cavities, as illustrated in FIG. 7A, or may be formed by a continuous opening 43 (illustrated by one such opening 43C) extending across the entire array, as illustrated in FIG. 7B.

Device Operation

Figure 8:
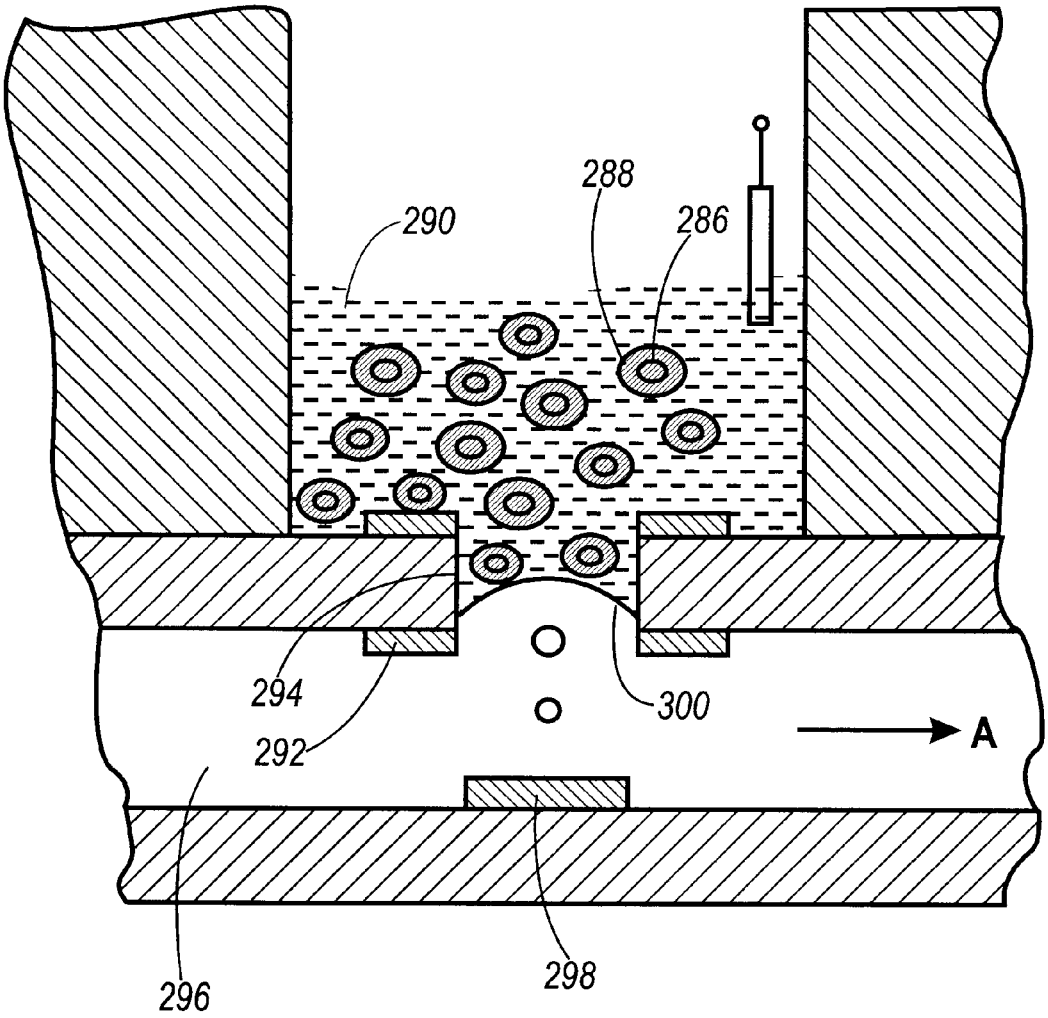
FIG. 8 is a process flow diagram for the marking of a substrate according to the present invention.

The process 70 involved in the marking of a substrate with marking material according to the present invention is illustrated by the steps shown in FIG. 8. According to step 72, a propellant is provided to a channel. A marking material is next metered into the channel at step 74. In the event that the channel is to provide multiple marking materials to the substrate, the marking materials may be mixed in the channel at step 76 so as to provide a marking material mixture to the substrate. By this process, one-pass color marking, without the need for color registration, may be obtained. An alternative for one-pass color marking is the sequential introduction of multiple marking materials while maintaining a constant registration between print head 34 and substrate 38. Since, not every marking will be composed of multiple marking materials, this step is optional as represented by the dashed arrow 78. At step 80, the marking material is ejected from an exit orifice at a distal end of the channel, in a direction toward, and with sufficient energy to reach a substrate. The process may be repeated with reregistering the print head, as indicated by arrow 83. Appropriate post ejection treatment, such as fusing, drying, etc. of the marking material is performed at step 82, again optional as indicated by the dashed arrow 84.

Marking Material

According to one embodiment of the present invention a solid, particulate marking material is employed for marking a substrate. The marking material particles may be on the order of 0.5 to 10.0 μm, preferably in the range of 1 to 5 μm, although sizes outside of these ranges may function in specific applications (e.g., larger or smaller ports and channels through which the particles must travel).

There are several advantages provided by the use of solid, particulate marking material. First, clogging of the channel is minimized as compared, for example, to liquid inks. Second, wicking and running of the marking material (or its carrier) upon the substrate, as well as marking material/substrate interaction may be reduced or eliminated. Third, spot position problems encountered with liquid marking material caused by surface tension effects at the exit orifice are eliminated. Fourth, channels blocked by gas bubbles retained by surface tension are eliminated. Fifth, multiple marking materials (e.g., multiple colored toners) can be mixed upon introduction into a channel for single pass multiple material (e.g., multiple color) marking, without the risk of contaminating the channel for subsequent markings (e.g., pixels). Registration overhead (equipment, time, related print artifacts, etc.) is thereby eliminated. Sixth, the channel refill portion of the duty cycle (up to 80% of a TIJ duty cycle) is eliminated. Seventh, there is no need to limit the substrate throughput rate based on the need to allow a liquid marking material to dry.

However, despite any advantage of a dry, particulate marking material, there may be some applications where the use of a liquid marking material, or a combination of liquid and dry marking materials, may be beneficial. In such instances, the present invention may be employed, with simply a substitution of the liquid marking material for the solid marking material and appropriate process and device changes apparent to one skilled in the art or described herein, for example substitution of metering devices, etc.

In certain applications of the present invention, it may be desirable to apply a substrate surface pre-marking treatment. For example, in order to assist with the fusing of particulate marking material in the desired spot locations, it may be beneficial to first coat the substrate surface with an adherent layer tailored to retain the particulate marking material. Examples of such material include clear and/or colorless polymeric materials such as homopolymers, random copolymers or block copolymers that are applied to the substrate as a polymeric solution where the polymer is dissolved in a low boiling point solvent. The adherent layer is applied to the substrate ranging from 1 to 10 microns in thickness or preferably from about 5 to 10 microns thick. Examples of such materials are polyester resins either linear or branched, poly(styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates and mixtures thereof and the like. This surface pretreatment may be applied from channels of the type described herein located at the leading edge of a print head, and may thereby apply both the pre-treatment and the marking material in a single pass. Alternatively, the entire substrate may be coated with the pre-treatment material, then marked as otherwise described herein. See U.S. patent application Ser. No. 08/041,353, incorporated herein by reference. Furthermore, in certain applications it may be desirable to apply marking material and pre-treatment material simultaneously, such as by mixing the materials in flight, as described further herein.

Likewise, in certain applications of the present invention, it may be desirable to apply a substrate surface post-marking treatment. For example, it may be desirable to provide some or all of the marked substrate with a gloss finish. In one example, a substrate is provided with marking comprising both text and illustration, as otherwise described herein, and it is desired to selectively apply a gloss finish to the illustration region of the marked substrate, but not the text region. This may be accomplished by applying the post-marking treatment from channels at the trailing edge of the print head, to thereby allow for one-pass marking and post-marking treatment. Alternatively, the entire substrate may be marked as appropriate, then passed through a marking device according to the present invention for applying the post-marking treatment. Furthermore, in certain applications it may be desirable to apply marking material and post-treatment material simultaneously, such as by mixing the materials in flight, as described further herein. Examples of materials for obtaining a desired surface finish include polyester resins either linear or branched, poly (styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates, and mixtures thereof and the like.

Other pre- and post-marking treatments include the underwriting/overwriting of markings with marking material not visible to the unaided eye, document tamper protection coatings, security encoding, for example with wavelength specific dyes or pigments that can only be detected at a specific wavelength (e.g., in the infrared or ultraviolet range) by a special decoder, and the like. See U.S. Pat. Nos. 5,208,630, 5,385,803, and 5,554,480, each incorporated herein by reference. Still other pre- and post-marking treatments include substrate or surface texture coatings (e.g. to create embossing effects, to simulate an arbitrarily rough or smooth substrate), materials designed to have a physical or chemical reaction at the substrate (e.g., two materials which, when combined at the substrate, cure or otherwise cause a reaction to affix the marking material to the substrate), etc. It should be noted, however, that references herein to apparatus and methods for transporting, metering, containing, etc. marking material should be equally applicable to pre- and post-marking treatment material (and in general, to other non-marking material) unless otherwise noted or as may be apparent to one skilled in the art.

Circulation and Valving System

Here we describe an electrostatic, toner circulation and valving system which is compatible with compact fabrication for multiple colors in a single ballistic aerosol marking channel. Moreover, the design provides efficient and uniform sourcing of toner or other marking material over the entire array of channels.

Figure 9:
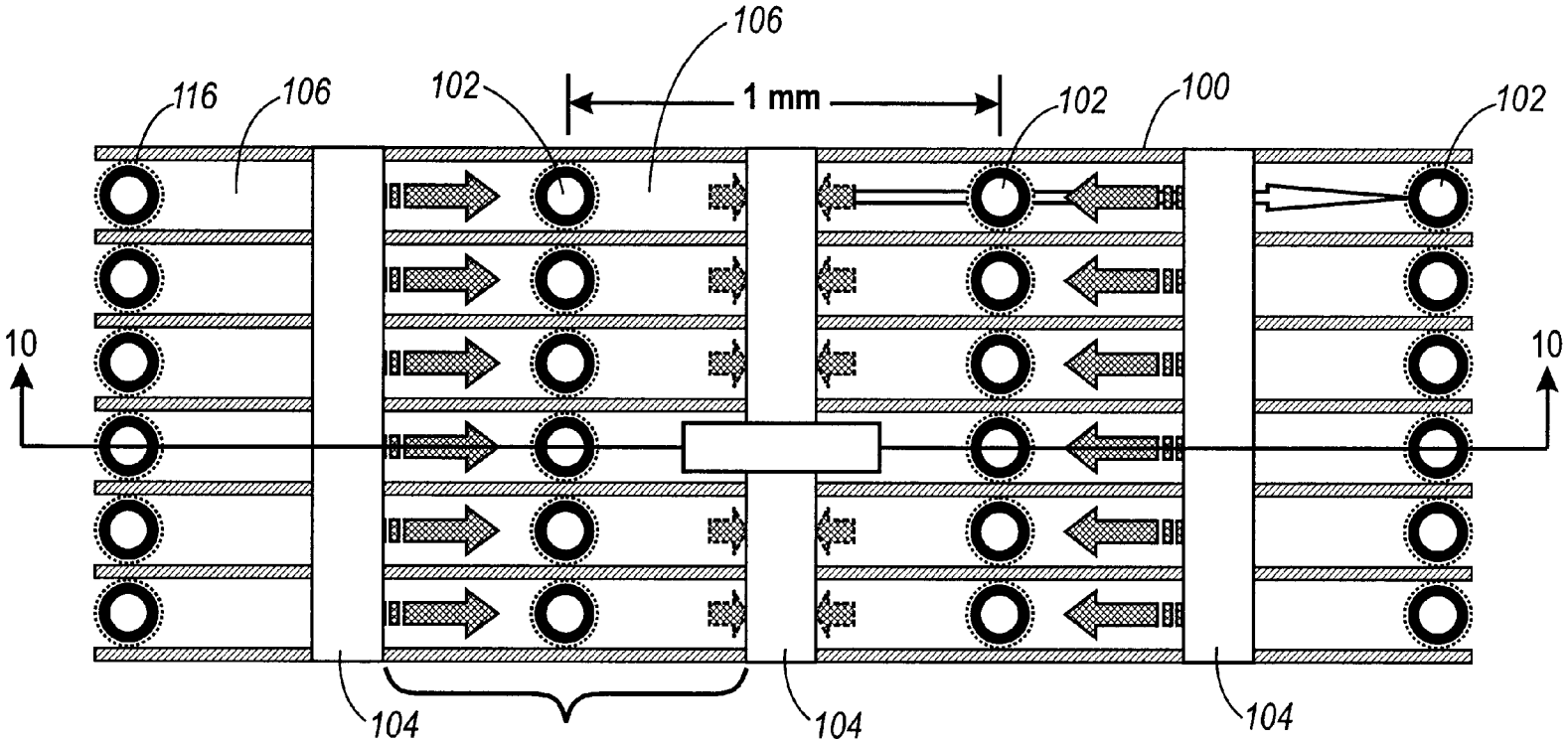
FIG. 9 is top view of a ballistic aerosol marking apparatus according to the present invention.
Figure 10:
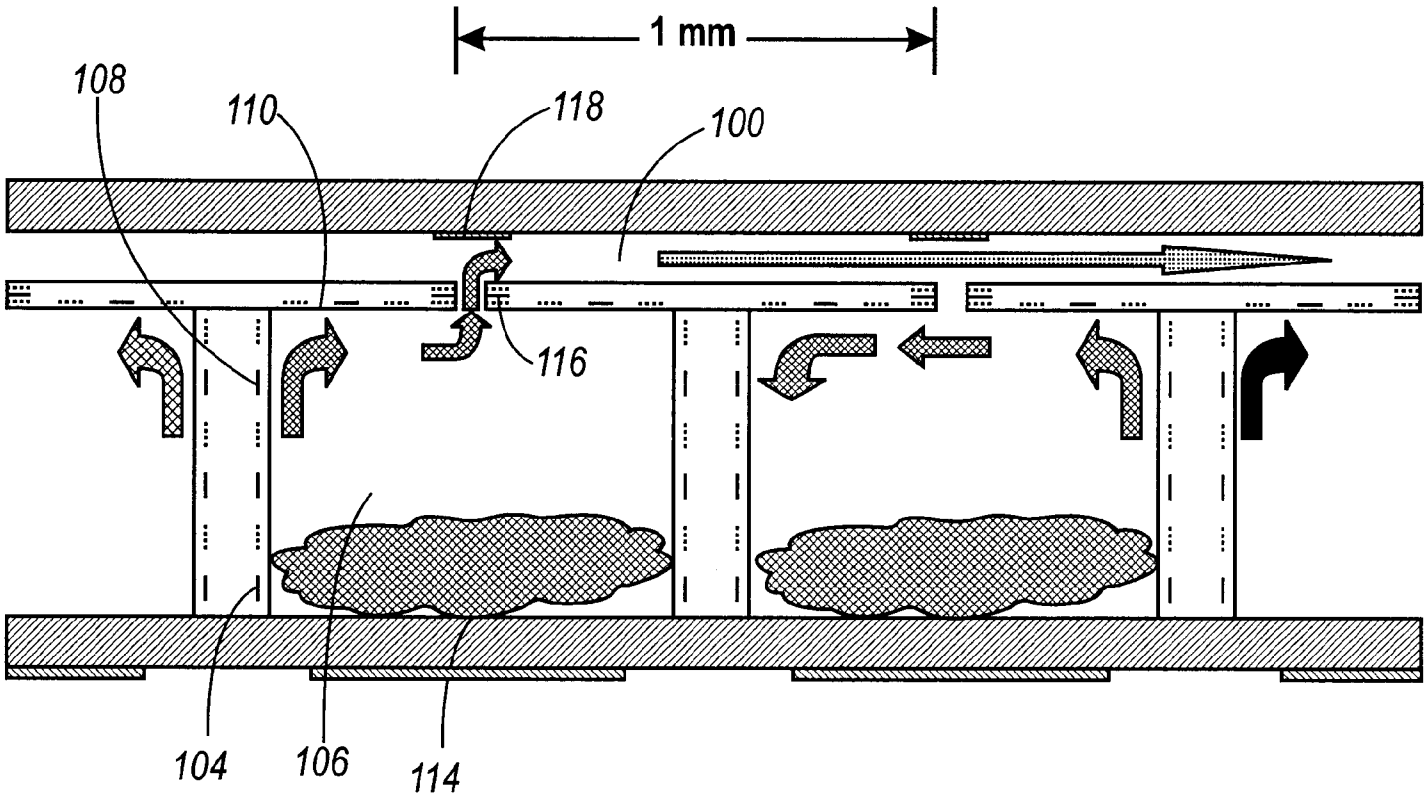
FIG. 10 is a cross-section view of the ballistic aerosol marking apparatus according to the present invention shown in FIG. 9.

FIG. 9 shows a schematic top view, and FIG. 10 shows a side view, of a set of ballistic aerosol marking channels 100. In the figure, propellant (e.g. air) flows from left to right continuously in each of the channels. Four vertical electrostatic particulate material transport devices of the type discussed in U.S. application Ser. Nos. 09/407,908, 09/407,332, or like valves are arrayed above and along each channel 100. Vertical walls 104 divide the toner circulation region of marking material reservoirs 106 into four (or more) chambers, one for each color (in this example, a four color marking device is described, however, it will be readily apparent that the present description applies to an arbitrary number of chambers and materials to be delivered from such chambers). The vertical walls 104 have embedded electrode structures 108 for electrostatic particulate material transport devices which transport marking material from a material cloud 114, up to an upper surface 110 of the material reservoir, thence along the surface to a port 112 containing an electrostatic valve 116, of a type described in U.S. application Ser. Nos. 09/163,893, 09/163,839, or other similar structure. Marking material is either accelerated through the valve 116, or is caused to pass by valve 116 based on the phasing of the valve waveforms (i.e., the valve is either attractive or repulsive depending on the phase). A phased accelerator electrode 118 on the opposite side of the channel 100 can also be used to attract or repel marking material. It should be noted that the material transport supplies all valves in parallel to minimize any depletion effects dependent on the state of other valves.

FIG. 10 illustrates a toner cloud 114, excited by a piezoelectric transducer, or other means such as aerosol flushing (not shown), which acts as a supply (and sink) for transport within the marking material reservior 106. (There are many ways to supply the toner to the transport 108, which have been enumerated in the aforementioned 09/163,893, for example a magnetic brush provides relatively uniform toner density to the transport.) The walls of cavity 106 may be fabricated from a variety of patternable materials, such as glass, plastic ceramic, etc. on which electrical circuitry may be formed (it should be noted that the driving circuitry for the transport may also be formed on the walls or other portions of cavity 106. In one embodiment, the transport electrodes (and possible driving and related circuitry) are formed photolithographically on two sides of the cavity walls. The electrodes on both sides of the walls may be driven synchronously by ganged drivers, for example at the ends of the walls. Marking material is carried continuously from the cloud 114, up the walls, transferred in phase to the top surface 110, then along to the next vertical wall where it is transported back to return to the toner cloud.

Partway within the top wall is valve 116, which may be a stacked device of the type described in the aforementioned and incorporated U.S. application Ser. No. 09/407,908. By phasing the valve 114 in or out of phase with the horizontal transport on surface 110, marking material can be attracted through or repelled from the orifice into the channel 100. The electrostatic forces are arranged to more than offset the residual aerodynamic forces arising from flow through the port due to pressure gradients between the pipe and toner source regions. The accelerator electrode 118 on the far side of channel 100 can also been used to provide additional field assistance in the valving. The top transport structure may be made from a 3- or 4-level metal flex or ceramic PC substrate. The substrate is bonded to a substrate body in which is formed the array of channels. The vertical walls may be bonded to the horizontal layer by one of various adhesive means using jigs to position and align the joints. If the PCB's are not already insulated, the system can then be dielectrically encapsulated using, for example, a thin, conformal deposition of parylene or other insulating film.

Figure 11:
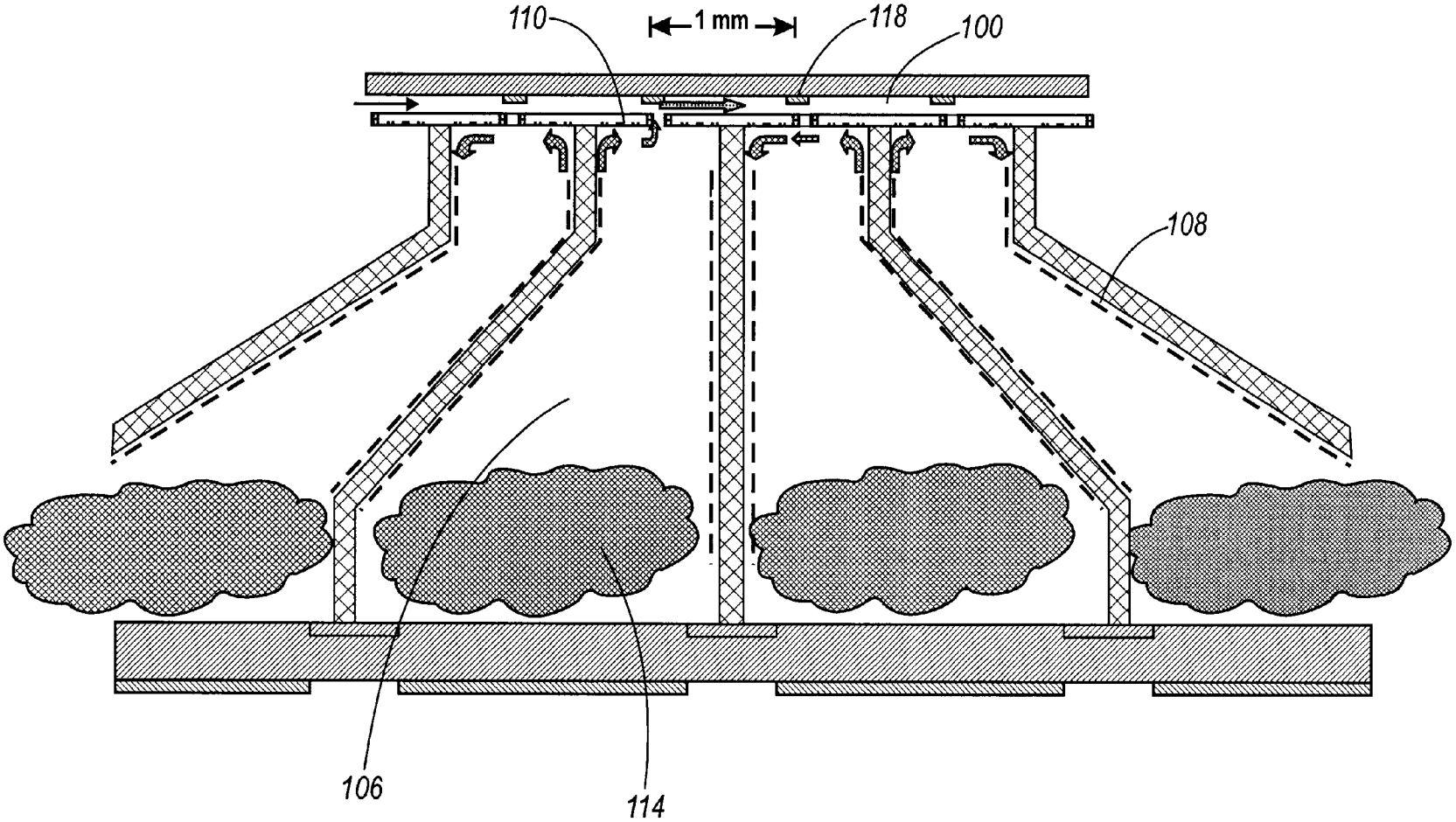
FIG. 11 is cross-section view of a ballistic aerosol marking apparatus according to another embodiment of the present invention.

In FIG. 11 we show that the flexible vertical walls are fanned out before bonding to the lower transducer plate. The large marking material reservoirs 106 can be filled from their ends.

Figure 12:
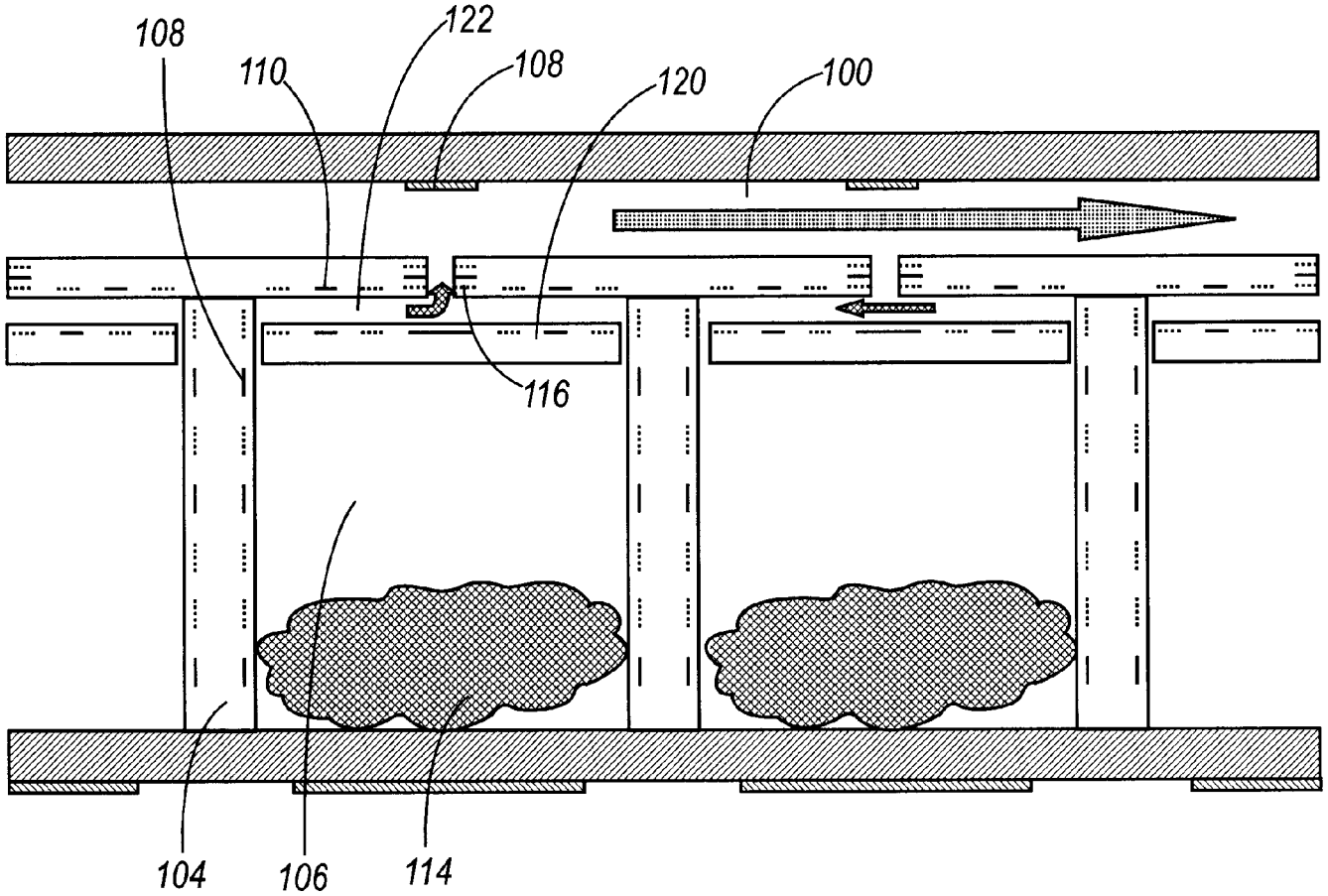
FIG. 12 is cross-section view of a ballistic aerosol marking apparatus according to still another embodiment of the present invention.

FIG. 12 shows, as an additional feature, an ancillary electrostatic material moving structure 120 to provide a 3-dimensional travelling wave. This is particularly useful to avoid marking material loss by dropping from surface 110 in the gravitational field. The device of this embodiment can also minimize detachment due to air streams from channel 100. The confined material delivery channel 122 has high air impedance and reduces back streaming from, or into, channel 100.

Figure 13:
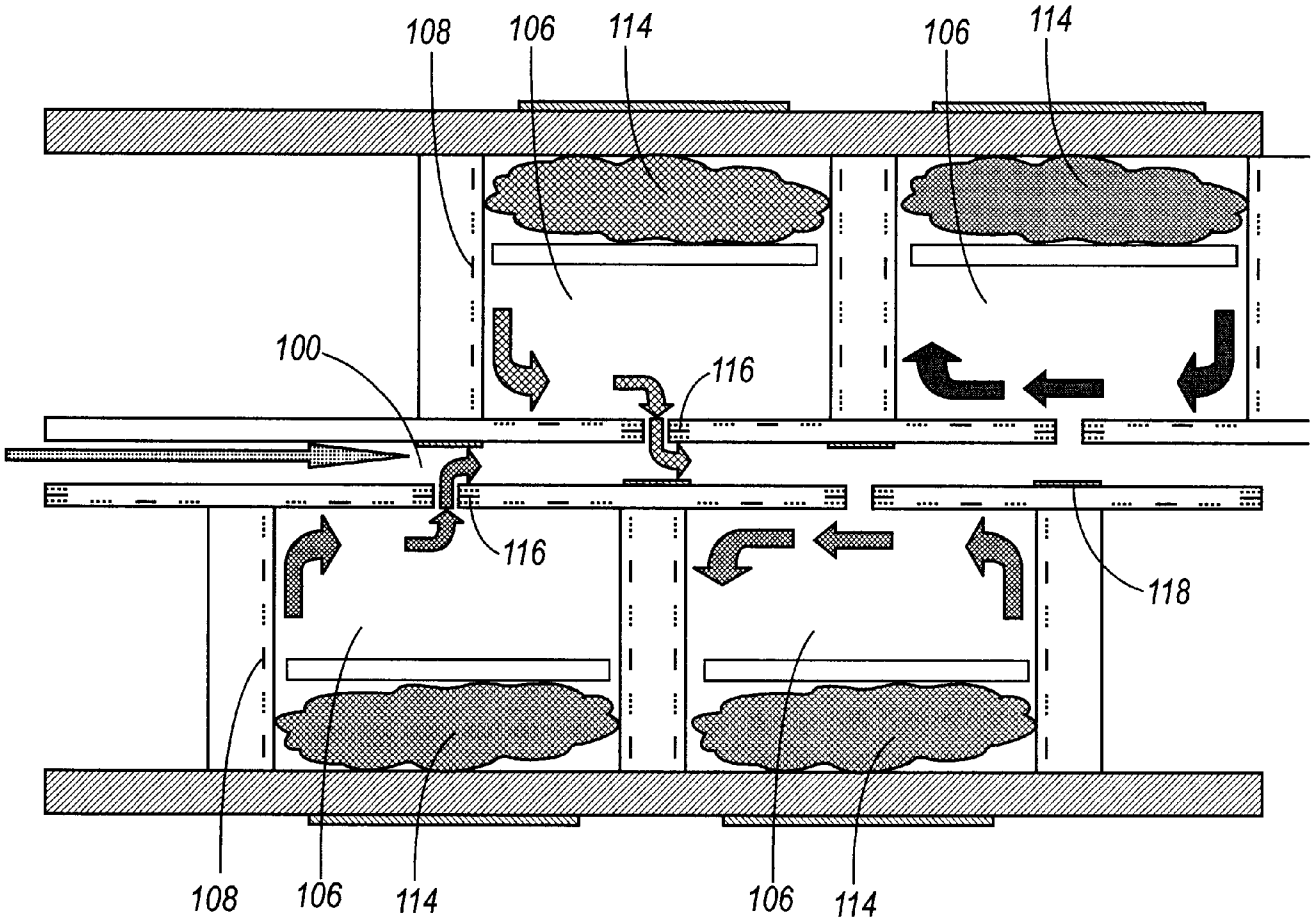
FIG. 13 is cross-section view of a ballistic aerosol marking apparatus according to yet another embodiment of the present invention.

FIG. 13 shows that the four color marking material injection systems can be folded into a 2-over/2-under architecture.

Figure 14:
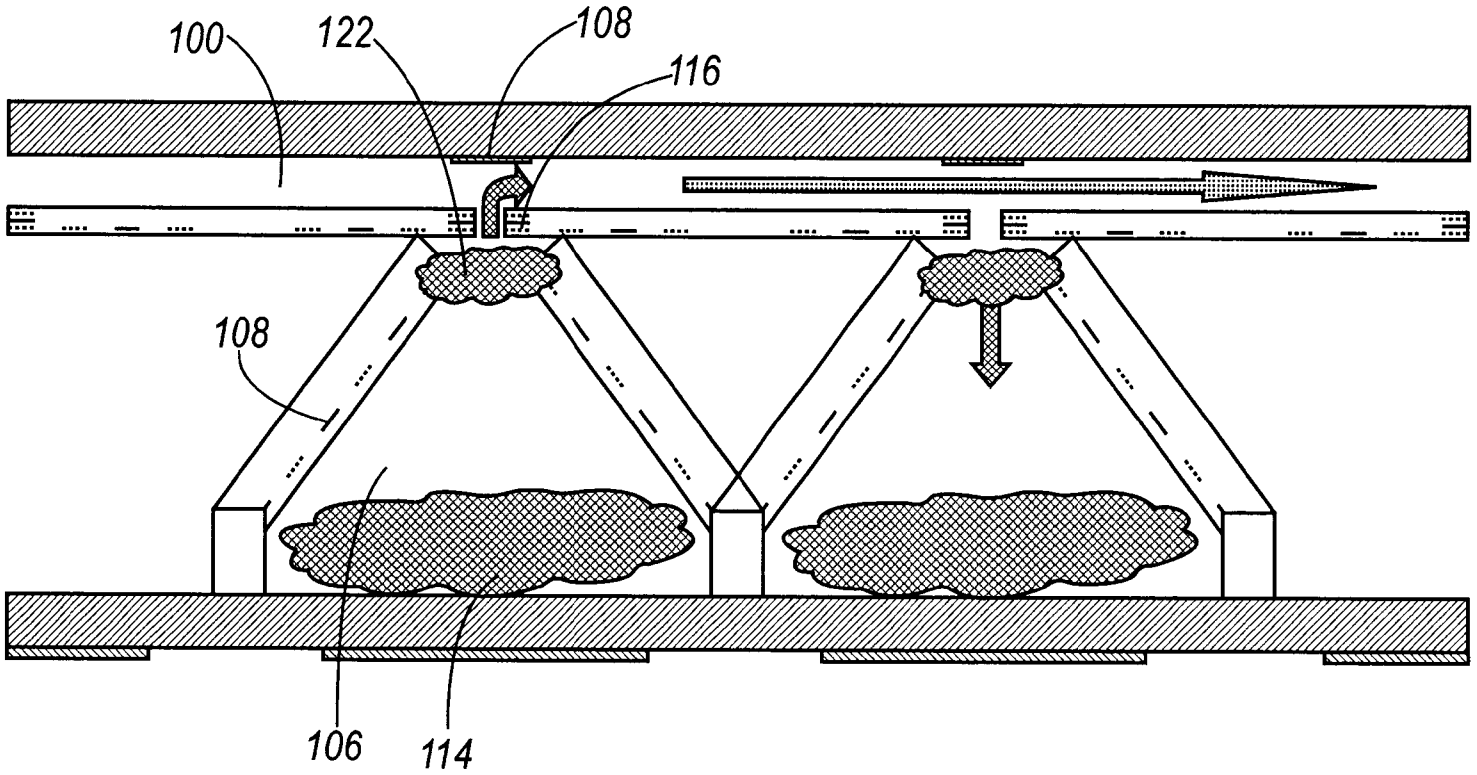
FIG. 14 is cross-section view of a ballistic aerosol marking apparatus according to a further embodiment of the present invention.

With reference to FIG. 14, an alternative to a continuous recirculating marking material transport is to use one or more electrostatic material transports and to dump the marking material at a location near the inlet of the electrostatic port valve 116. This marking material aerosol 122 can be created with desired density and location, and is therefore advantageous relative to a macroscopic aerosol.

It will now be appreciated that various embodiments of a ballistic aerosol marking apparatus, and specifically mechanisms for the transport of marking material, have been disclosed herein. These embodiments encompass a complete device for applying a single marking material, one-pass full-color marking material, applying a material not visible to the unaided eye, applying a pre-marking treatment material, a post-marking treatment material, etc., with the ability to tailor the position of the marking material in or at the ports to address considerations of material quantity and quality control, charge requirements, etc. However, it should also be appreciated that the description herein is merely illustrative, and should not be read to limit the scope of the invention nor the claims hereof.

What is claimed is:

1. A marking apparatus, comprising:

a marking material reservoir, said marking material reservoir having a plurality of electrodes and associated electrical interconnections disposed therewithin, said electrodes interconnected to establish a travelling electrostatic wave for movement of a dry particulate marking material located within said marking material reservoir;

a structure having formed therein a channel for receiving said marking material from said ring material reservoir, said reservoir is provided with a lower surface, an upper surface, and first and second side surfaces, each side surface extending between and in physical contact with said lower surface and said upper surface, and further wherein said plurality of electrodes are disposed on said first and second side surfaces and said upper surface, and still further where said port is located in said upper surface, such that the plurality of electrodes causes portions of the marking material located within said reservoir to flow from a pool of marking material in a direction up said first side surface, along said upper surface and across said port, and down said second side surface there to return to the pool of marking material, and said metering device to selectively interrupt said flow and cause at least one of the portions of the marking material to travel through said port to thereby be introduced into said channel;

a port communicatively connecting said marking material reservoir and said channel so as to allow said marking material to travel from said marking material reservoir to said channel; and a metering device associated with said port, said port to selectively introduce said marking material from said reservoir into said at least one channel;

said traveling wave to assist with the transport of said marking material in a direction towards said port.

2. The marking apparatus of claim 1, wherein said first and second side surfaces are formed of a material having embedded therein said plurality of electrodes and associated electrical interconnections.

3. The marking apparatus of claim 1, wherein said first and second side surfaces are positioned a first distance apart where they connect with said lower surface and a second distance apart where they connect with said upper surface, said first distance being greater than said second distance.

4. The marking apparatus of claim 1, where said first and second side surfaces are formed of a material selected from the group comprising: glass, plastic, and ceramic.

5. The marking apparatus of claim 1, wherein said marking material reservoir has further formed therein driving circuitry for establishing and controlling a travelling wave across said plurality of electrodes.

6. The marking apparatus of claim 5, wherein the plurality of electrodes includes first electrodes located on said first side surface and second electrodes located on said second side surface, said driving circuitry driving said first electrodes synchronously with said second electrodes.

7. The marking apparatus of claim 1 wherein at least said upper surface and said first and second side surfaces are dielectrically encapsulated with a conformal coating.

8. The marking apparatus of claim 7, wherein said conformal coating is a deposition of parylene.

9. A material reservoir for a marking apparatus, the marking apparatus including a metering device for controllably introducing a dry particulate marking material into a channel and directing said marking material to a substrate, comprising:

a generally planar upper wall structure extending in a first plane and having first and second surfaces, said first surface being an electrode-bearing surface oriented to face toward said marking material reservoir, said second surface forming a part of said channel and oriented to face away from said marking material reservoir, said wall structure having a port formed therein which extends from said first surface to said second surface to thereby communicatively connect said marking material reservoir and said channel;

first and second side walls, each side wall extending between and in physical contact with said substrate and said upper wall structure, each side wall having an electrode-bearing surface oriented such that the electrode-bearing surface of said first side wall is opposite of and facing said electrode-bearing surface of said second wall; and a generally planar ancillary wall structure extending in a plane generally parallel to said first plane, extending between but not in physical contact with said first and second side walls, and located proximate but not in physical contact with said upper surface, said ancillary wall structure having an electrode-bearing surface which is opposite of and facing said electrode-bearing surface of said upper wall structure, thereby defining an electrode transport passage between said upper wall structure and said ancillary wall structure;

one mode of operation of electrodes in said electrode-bearing surfaces to produce travelling electrostatic waves to transport a portion of said dry particulate marking material in a flow from a pool of marking material in a direction up said first side wall, through said electrode transport passage between said upper wall structure and said ancillary wall structure and across said port, and down said second side wall there to return to the pool of marking material, said metering device to selectively interrupt said flow and cause marking material to travel through said port to thereby be introduced into said channel.

10. A removably replaceable cartridge for use in a marking apparatus of a type including a structure having a channel formed therein for receiving marking material from a marking material reservoir, comprising:

a marking material reservoir, said marking material reservoir having a plurality of electrodes and associated electrical interconnections disposed therewithin, said electrodes interconnected to establish a travelling electrostatic wave for movement of said marking material located within said marking material reservoir, said reservoir is provided with a lower surface, an upper surface, and first and second side surfaces, each side surface extending between and in physical contact with said lower surface and said upper surface, and further wherein said plurality of electrodes are disposed on said first and second side surfaces and said upper surface, said first and second side surfaces are formed of a material having embedded therein said plurality of electrodes and associated electrical interconnections, and still further where said port is located in said upper surface, such that the plurality of electrodes causes portions of the marking material located within said reservoir to flow from a pool of the marking material in a direction up said first side surface, along said upper surface and across said port, and down said second side surface there to return to the pool of the marking material, said metering device to selectively interrupt said flow and cause at least one of the portions of the marking material to travel through said port to thereby be introduced into said channel;

a port communicatively connecting said marking material reservoir and said channel so as to allow said marking material to travel from said marking material reservoir to said channel; and a metering device associated with said port capable of selectively introducing said marking material from said reservoir into said at least one channel;

whereby said traveling wave may assist with the transport of marking material in a direction towards said port.

11. The cartridge of claim 10, where said first and second side surfaces are formed of a material selected from the group comprising: glass, plastic, and ceramic.

12. The cartridge of claim 10, wherein said marking material reservoir has further formed therein driving circuitry for establishing and controlling a travelling wave across said plurality of electrodes.

13. The cartridge of claim 12, wherein said plurality of electrodes includes first electrodes located on said first side surface and second electrodes located on said second side surface; said driving circuitry to drive said first electrodes synchronously with said second electrodes.

14. A removably replaceable cartridge for use in a marking apparatus of a type including a structure having a channel formed therein for receiving marking material from a marking material reservoir, comprising:

a marking material reservoir, said marking material reservoir having a plurality of electrodes and associated electrical interconnections disposed therewithin, said electrodes interconnected to establish a travelling electrostatic wave for movement of said marking material located within said marking material reservoir, said reservoir is provided with a lower surface, an upper surface, and first and second side surfaces, each side surface extending between and in physical contact with said lower surface and said upper surface, said first and second side surfaces positioned a first distance apart where they connect with said lower surface and a second distance apart where they connect with said upper surface, said first distance being greater than said second distance and further wherein said plurality of electrodes are disposed on said first and second side surfaces and said upper surface, and still further where said port is located in said upper surface, such that the plurality of electrodes causes portions of the marking material located within said reservoir to flow from a pool of the marking material in a direction up said first side surface, along said upper surface and across said port, and down said second side surface there to return to the pool of the marking material, said metering device to selectively interrupt said flow and cause at least one of the portions of the marking material to travel through said port to thereby be introduced into said channel a port communicatively connecting said marking material reservoir and said channel so as to allow said marking material to travel from said marking material reservoir to said channel; and a metering device associated with said port capable of selectively introducing said making material from said reservoir into said at least one channel;

whereby said traveling wave may assist with the transport of marking material in a direction towards said port.

15. A removably replaceable cartridge for use in a marking apparatus of a type including a structure having a channel formed therein for receiving marking material from a marking material reservoir, comprising:

a marking material reservoir, said marking material reservoir having a plurality of electrodes and associated electrical interconnections disposed therewithin, said electrodes interconnected to establish a travelling electrostatic wave for movement of said marking material located within said marking material reservoir, said reservoir is provided with a lower surface, an upper surface, and first and second side surfaces, said upper surface and said first and second side surfaces are dielectrically encapsulated with a conformal coating, each side surface extending between and in physical contact with said lower surface and said upper surface, and further wherein said plurality of electrodes are disposed on said first and second side surfaces and said upper surface, and still further where said port is located in said upper surface, such that the plurality of electrodes causes portions of the marking material located within said reservoir to flow from a pool of the marking material in a direction up said first side surface, along said upper surface and across said port, and down said second side surface there to return to the pool of the marking material, said metering device to selectively interrupt said flow and cause at least one of the portions of the marking material to travel through said port to thereby be introduced into said channel;

a port communicatively connecting said marking material reservoir and said channel so as to allow said marking material to travel from said marking material reservoir to said channel; and a metering device associated with said port capable of selectively introducing said marking material from said reservoir into said at least on channel;

whereby said traveling wave may assist with the transport of marking material in a direction towards said port.

16. The cartridge of claim 15, wherein said conformal coating is a deposition of parylene.

* * * * *